US007255626B2

(12) United States Patent
Fu

(10) Patent No.: US 7,255,626 B2
(45) Date of Patent: Aug. 14, 2007

(54) TUTORIAL AND WITS-INCREMENT TOY CAR

(76) Inventor: Hung-Peng Fu, 3F, No.11, Alley 2, Lane 111, Baoping Rd., Yonghe City, Taipei County (TW)

( * ) Notice: Subject to any disclaimer, the term of this patent is extended or adjusted under 35 U.S.C. 154(b) by 19 days.

(21) Appl. No.: 11/131,266

(22) Filed: May 18, 2005

(65) Prior Publication Data

US 2006/0264150 A1 Nov. 23, 2006

(51) Int. Cl.
*A63H 17/267* (2006.01)

(52) U.S. Cl. ..... 446/465; 446/469; 280/43.13

(58) Field of Classification Search ..... 446/437, 446/441, 448, 465, 466, 469, 462, 463; 280/43.13, 280/43.21, 43.22, 43.23
See application file for complete search history.

(56) References Cited

U.S. PATENT DOCUMENTS 4,655,724 A * 4/1987 Law ..... 446/443
5,273,480 A * 12/1993 Suto ..... 446/456
5,762,533 A * 6/1998 Tilbor et al. ..... 446/466
5,882,241 A * 3/1999 Mullaney et al. ..... 446/462

* cited by examiner

*Primary Examiner*—Kien Nguyen
(74) *Attorney, Agent, or Firm*—Birch, Stewart, Kolasch & Birch, LLP

(57) ABSTRACT

This invention is directed to a device of "a tutorial and wits-increment toy car", mainly consists of a shell body with gear case at both sides, and within the gear case sets up multiple wheels used to act as mechanical powers transfer connection between the motor and the wheels, whereas at the top and back of the shell body fixed with multiple metal buttons and hexagonal buttons. According to the former structure, altering the size of wheel can adjust the wheel rotating speed, and makes the learners understand the basic electronic and mechanical control theory while playing the toy car, and makes the present invention become a best tool of cerebration training.

8 Claims, 7 Drawing Sheets

TUTORIAL AND WITS-INCREMENT TOY CAR

BACKGROUND OF THE INVENTION

I. Field of the Invention

The present invention is relates to the structure of "a tutorial and wits-increment toy car", more particularly to a kind of toy car that the students can exercise some basic electronic and mechanical control theory once playing the toy car, and cumulate some knowledge despite of entertaining at the same time.

II. Description of the Prior Art

The major purpose of practical experiment is to invite the children in interesting the natural environment by showing them various kind of natural phenomenon, studying the natural issues, and going down to bedrock; and thereby gradually nurse the deductive science spirits; In general, to inspire students thinking of and resolving problems is better than to pour knowledge by lecture in the class. If the instructor in class spends most of time in lecture, the students will have less time to exercise practical experiments and could hardly get the whole concept of the lesson being taught. The conventional experiment material sometimes leads to a default result, if exercise in accordance with the predefined procedures step by step.

Education is not only to teach student how to solve problems, but also to teach student how to find out potential issues by self-training. Tedious and boring electronic circuit course in the current electronic department of professional senior high school and college can not invite student's interesting.

Furthermore, decades ago students have to buy electronic experiment materials such as transistors, capacitors, resistors, IC board, wire solder, etc. depends what kind of experiments handed out, and welding these components on the board according to the circuit layout offered by the teacher. Nowadays many stores also sell various kind of finished works to meet students' course requirements, the students then buy the finished works instead of assembling by person according to the instructor's circuit layout, and therefore get less opportunity to understand the relationship between those electronic components, and save self experiment time for personal purpose.

SUMMARY OF THE INVENTION

It is therefore a primary object of the present invention to provide "a tutorial and wits-increment toy car" and makes the students interest in electronic and mechanical control theory of a toy car, and gets some related knowledge while playing the toy car.

Another object of the present invention of "the tutorial and wits-increment toy car" primarily includes a shell body, and characterized by the shell body which possesses left motor and right motor fixed at left and right hand side; the motor shaft of left motor extends to the left hand side of the shell body, and the motor shaft of right motor extends to the right hand side of the shell body. A driving wheel is fixed on the motor shaft. A central shaft is fixed right under the driving wheel. A bottom shaft fixed right under the central shaft. A front side shaft fixed in front of the central shaft, and a rear side shaft fixed in back of the central shaft. A front wheel shaft is fixed right under the front side shaft, and a rear wheel shaft is fixed right under the rear side shaft. A terminal gearing differential wheel is fixed on the outer side of the front wheel shaft and the rear wheel shaft, and the outer side of central shaft, bottom shaft, front side shaft, and rear side shaft are mounted on a differential wheel. A crystal-made gear case contains motor shaft, driving wheel, central shaft, bottom shaft, front side shaft, rear side shaft, terminal gearing differential wheel and all other differential wheels; and all components are between outer gear case and shell body; whereas a wheel, which is extended out of the gear case, is fixed on the front wheel shaft and rear wheel shaft. Multiple metal buttons fixed at the back of the shell body are used to connect with left and right motor, battery box, and power switch by power cord; a stationary hook is arranged on both side of front shell body. At the bottom of the shell body sets up a battery box and a power switch. At the top of shell body sets up multiple flat hexagonal convexities and groove hexagonal convexities which is designed into radial grooves on top surface with a hole in the center, whereas the groove hexagonal convexities is opposite to a hexagonal nail with radial grooves at bottom mapped to the radial grooves of groove hexagonal convexities; and a round pole fixed under the center of the hexagonal nail opposite to the hole of groove hexagonal convexities.

As shown above, the present invention of "the tutorial and wits-increment toy car" consists of a functional board on top of shell body with control circuits for the purpose of audio, optical, infrared and remote control. The control circuits further connects with multiple metal buttons so that control circuits can obtain power supply to control the rotate speed of left and right motor. The wheel speed can also be altered by changing different sets of differential wheel. These schemes can spur the student's creative ability on electronic and mechanic theory and raise the student's science and problem-resolving skill.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accomplishment of the above-mentioned object of the present invention will become apparent from the following description and its accompanying drawings which disclose illustrative and embodiment of the present invention, and are as follows.

DETAILED DESCRIPTION OF THE PREFERRED EMBODIMENTS

Figure 1:
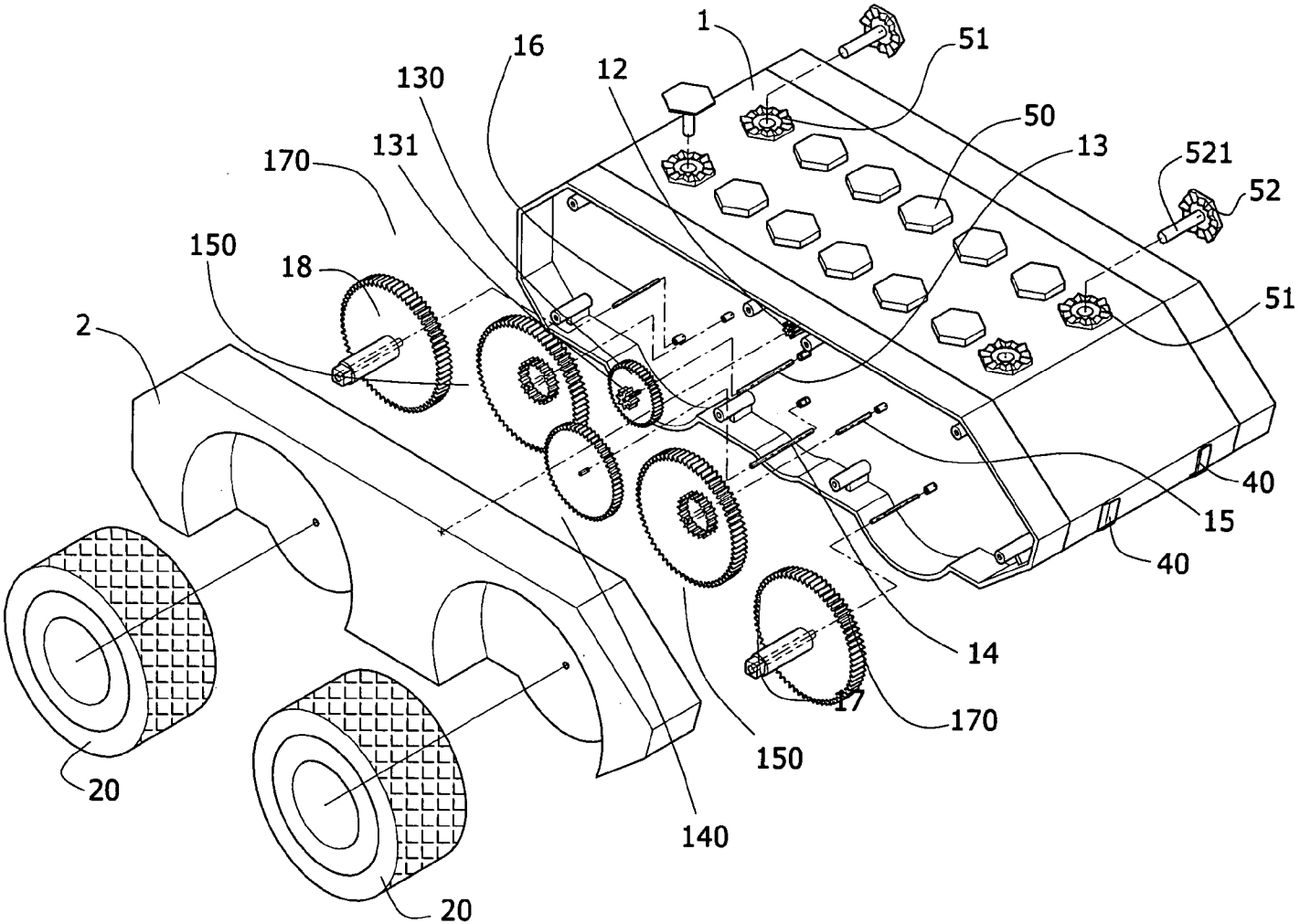
FIG. 1 the exploded perspective view of the present invention
Figure 2:
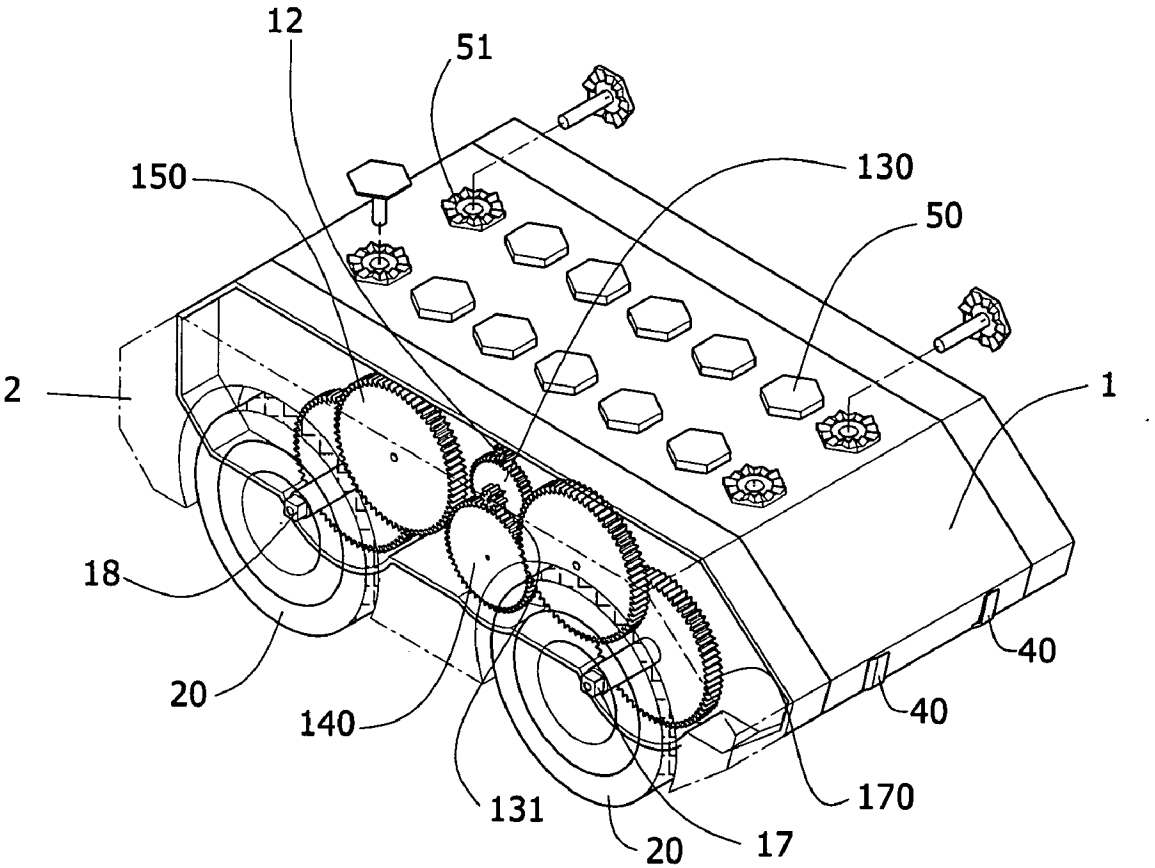
FIG. 2 the perspective view of the assembled present invention
Figure 3:
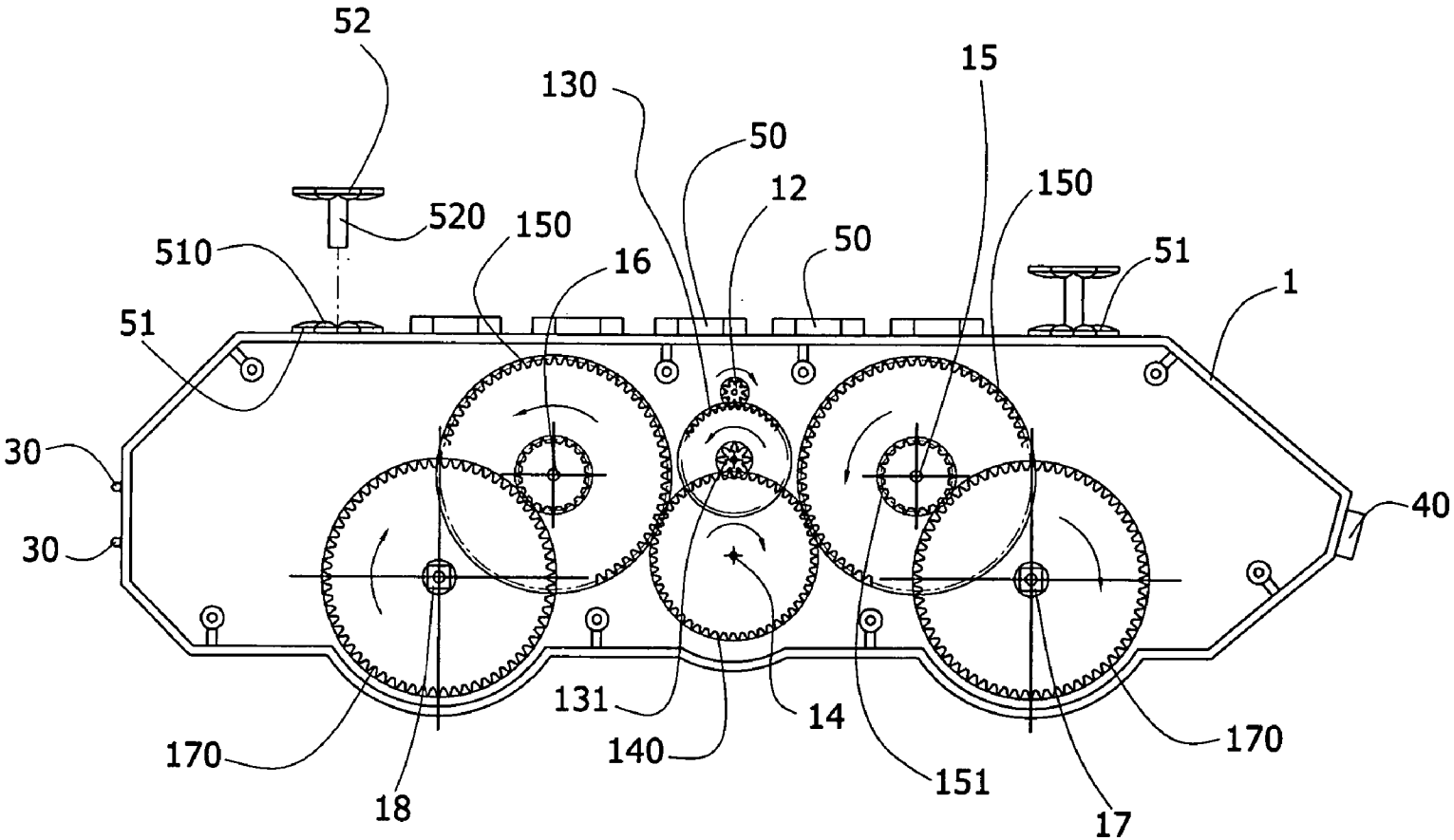
FIG. 3 the action perspective view of the present invention
Figure 4:
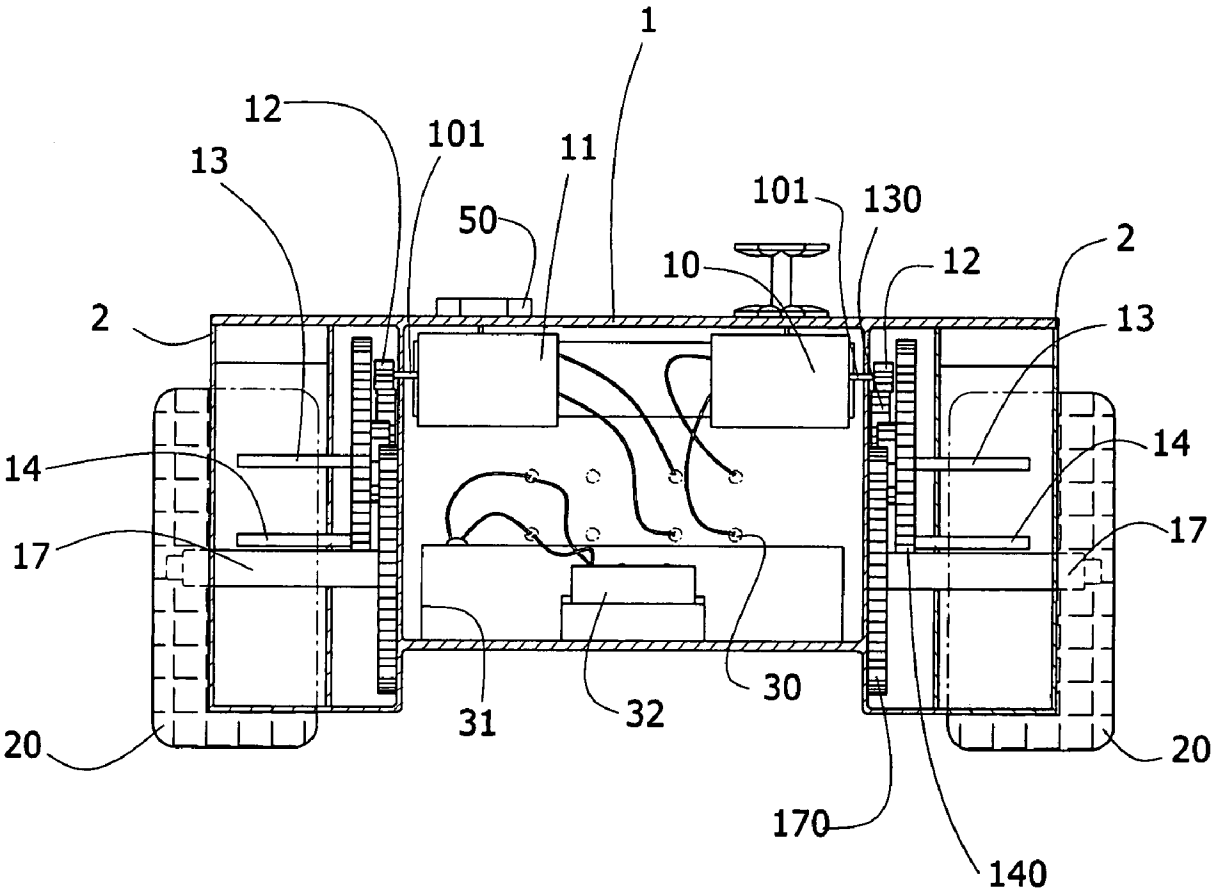
FIG. 4 the front perspective view of the present invention
Figure 5:
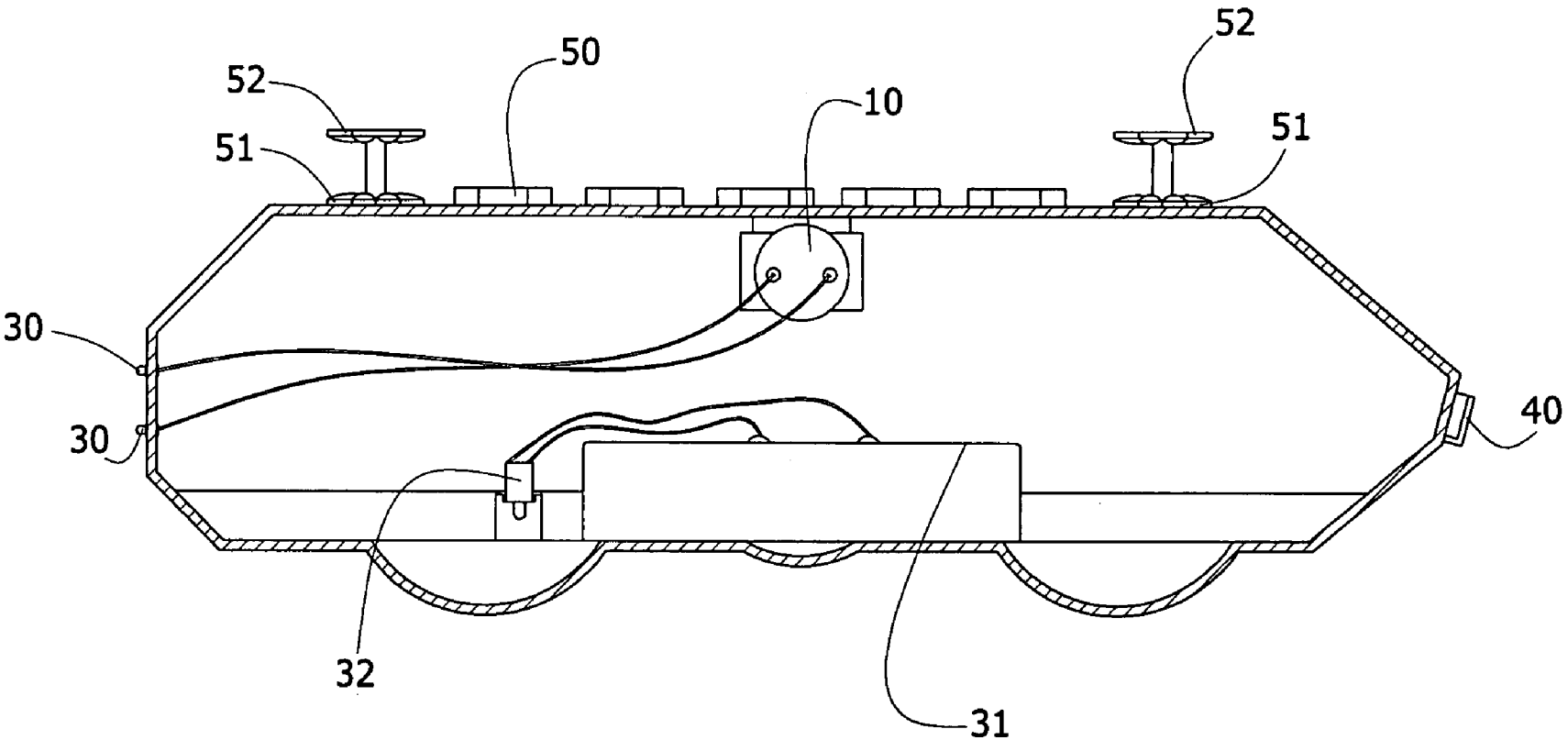
FIG. 5 the cross-sectional perspective view of the present invention.
Figure 6:
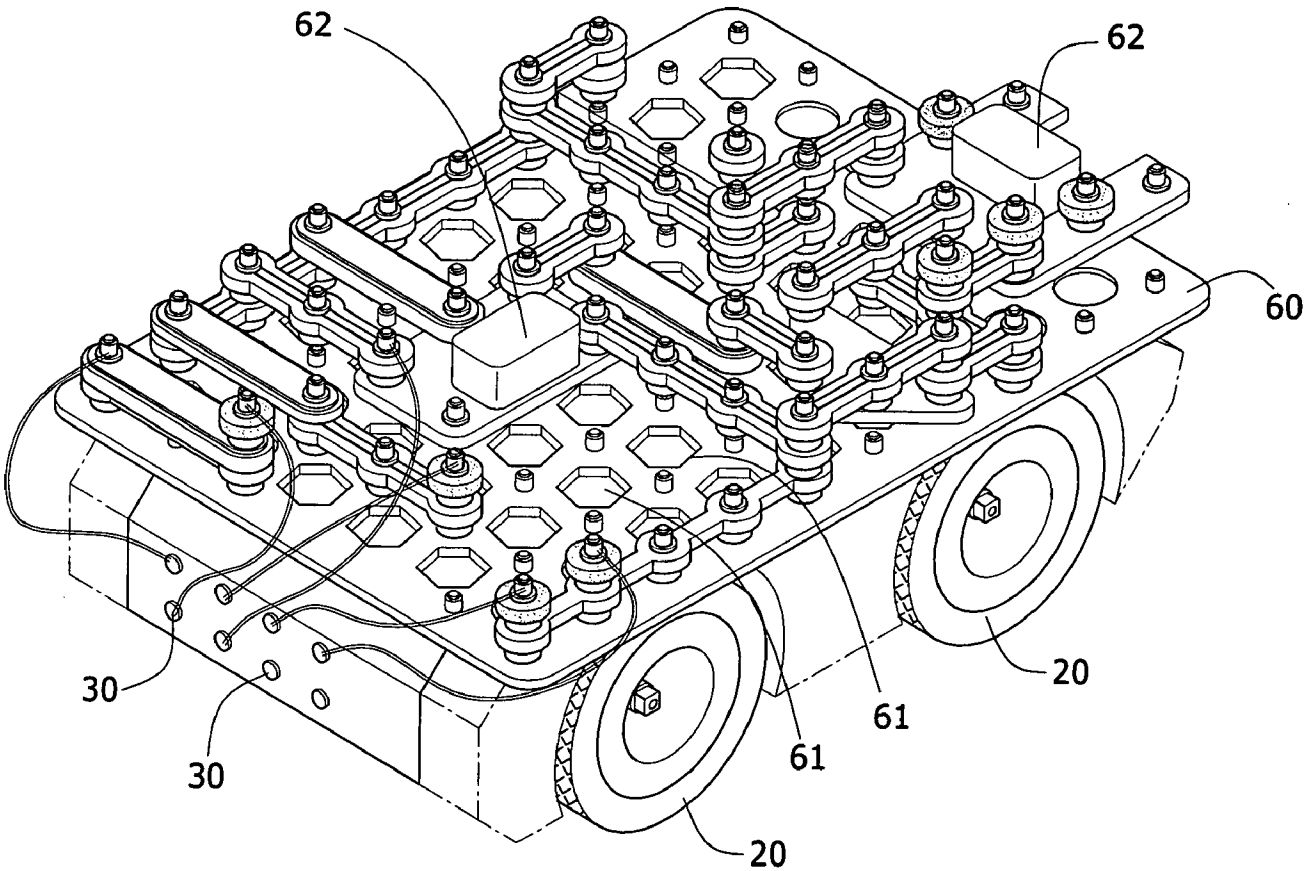
FIG. 6 the practical example view of the present invention
Figure 7:
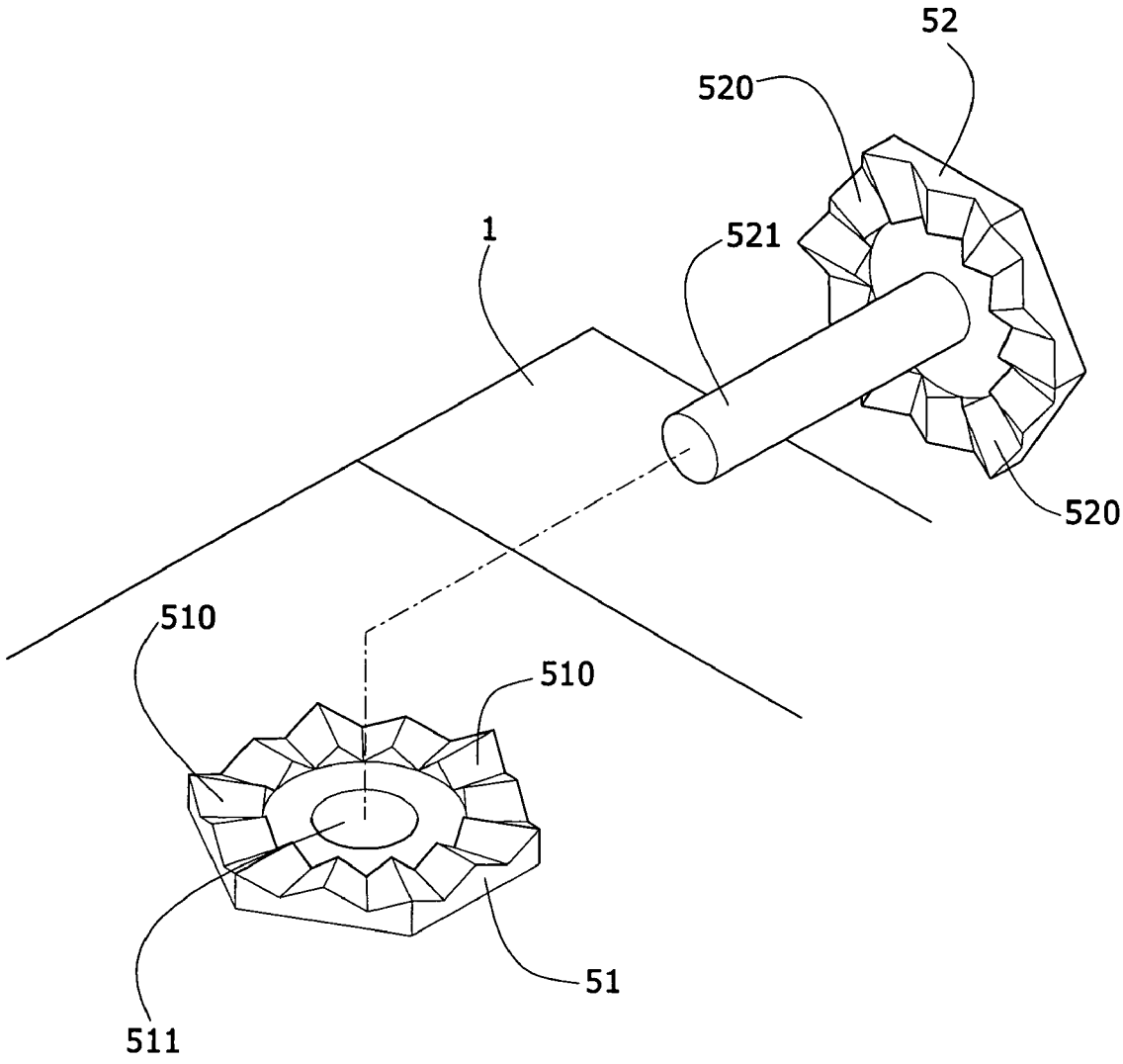
FIG. 7 the partial enlargement view of the present invention

First of all, referring to FIG. 1, 2, 3, 4, 5, 6, 7, "the tutorial and wits-increment toy car" in accordance wit the present invention primarily includes a shell body 1, wherein:

the shell body 1 possesses left motor 10 and right motor 11 (refer to FIG. 4) sets up at left and right hand side individually, the motor shaft 101 of left motor 10 extends to the left hand side of the shell body 1, and the motor shaft 101 of right motor 11 extends to the right hand side of the shell body 1. A driving wheel 12 fixed on the motor shaft 101. A central differential wheel 130 fitted on central shaft 13 is fixed right under the driving wheel 12, and mesh with the driving wheel 12; a smaller wheel 131 (refer to FIG. 1) is fixed on the center of the central differential wheel 130.

A bottom differential wheel 140 is fitted on the outer side of the bottom shaft 14 right under the central shaft 13, and mesh with the central smaller wheel 131.

A front side shaft 15 is fixed in front of the central shaft 13, and a rear side shaft 16 is fixed in back of the central shaft 13, and a gearing differential wheel 150 is arranged on the outer side of the front side shaft 15 and rear side shaft 16 respectively. Both of the gearing differential wheels 150 are meshed with the bottom differential wheel 140, and fixed on a small gearing wheel 151 respectively.

A front wheel shaft 17 is fixed right under the front side shaft 15, and a rear wheel shaft 18 is fixed right under the rear side shaft 16. A terminal gearing differential wheel 170, which is engaged with the small gearing wheel 151, is fixed on the bottom outer side of the front wheel shaft 17 and the rear wheel shaft 18 respectively.

A crystal gear case 2, is set up at both side of the shell body 1, contains motor shaft 101, central shaft 13, bottom shaft 14, front side shaft 15, rear side shaft 16, driving wheel 12, central differential wheel 130, bottom differential wheel 140, gearing differential wheel 150 and terminal gearing differential wheel 170; all are between outer gear case 2 and shell body 1; whereas a wheel 20, which is extended out of the gear case 2, is fixed on the front wheel shaft 17 and rear wheel shaft 18.

At the bottom of the shell body 1 sets up a battery box 31 and a power switch 32, and multiple metal buttons 30 at the back of the shell body 1 are used to connect with left motor 10 and right motor 11, battery box 31, power switch 32 by power cord; and a stationary hook 40 is arranged on both side of front shell body 1.

At the top of shell body 1 sets up multiple flat hexagonal convexities 50 and groove hexagonal convexities 51 which is designed into radial grooves 510 on top surface with a hole 511 in the center, whereas the groove hexagonal convexities 51 is opposite to a hexagonal nail 52 with radial grooves 520 at bottom mapped to the radial grooves 510 of groove hexagonal convexities 51; and a round pole 521 fixed under the center of the hexagonal nail 52 opposite to the hole 511 of groove hexagonal convexities 51.

As shown above, the present invention of "the tutorial and wits-increment toy car" consists of a functional board 60 on the top of shell body 1 that has multiple hexagonal holes 61 opposite to flat hexagonal convexity 50, groove hexagonal convexity 51 and hexagonal nail 52; the control circuits 62 also set up on functional board 60 for the purpose of audio, optical, infrared and remote control. The control circuits 62 further connect with multiple metal buttons 30 which are further connected with left motor 10, right motor 11, battery box 31 and power switch 32 by power cord, so that control circuits 62 not only can obtain power supply from battery box 31, but also change the received power voltage of input into left motor 10 and right motor 11 to change the motor rotate speed; power switch 32 used to control the on and off of the power supply.

Furthermore, while the left 10 and right motor 11 rotate, the driving wheel 12 will rotate the central differential wheel 130 and the central smaller wheel 131 which rotates bottom differential wheel 140 to drive gearing differential wheel 150 and gearing smaller wheel 151 to rotate, then drive terminal gearing wheel 170, which finally rotate the front wheel shaft 17 and rear wheel shaft 18 to drive the wheel 20.

In addition, the present invention of "the tutorial and wits-increment toy car" can tear apart the wheels 20 and gear case 2 from both sides of the shell body 1 in exchange of different sets of central differential wheel 130, bottom differential wheel 140, and gearing differential wheel 150 with different wheel 20 rotate speed. In practice of controlling the toy car, students will find out it is easy and fun to assemble a remote control automatic toy car, and get some knowledge.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A tutorial toy car comprising:

a shell body containing a left motor and a right motor, a motor shaft extending from the left motor to a left side of the shell body, and a motor shaft extending from the right motor to a right side of the shell body, a driving wheel being fixed on each of the motor shafts and a central shaft being fixed under each of the driving wheels with each central shaft having a central shaft differential wheel meshed with the driving wheel adjacent the central differential wheel, a central smaller wheel being provided on each of the central shaft differential wheels, the central smaller wheels meshing with a bottom differential wheel, the bottom differential wheel being on a bottom shaft fixed under the central shaft, a front side shaft being fixed in front of each of the central shafts, and a rear side shaft fixed behind each of the central shafts, a gearing differential wheel being provided on each of the front side shafts and the rear side shafts and being engaged with one of the bottom differential wheels, a center of each gearing differential wheel having a small wheel which meshes with one of terminal gearing differential wheel, a front wheel shaft being provided in front of and under the front side shaft, and a rear wheel shaft being provided behind and under the rear side shaft, each of the front wheel shafts and the rear wheel shafts have one of the terminal gearing differential wheels thereon;

a transparent gear case on each side of the shell body, the transparent gear case containing the motor shaft, central shaft, bottom shaft, front side shaft, rear side shaft, driving wheel, central differential wheel, bottom differential wheel, gearing differential wheel and terminal gearing differential wheel which are visible through the transparent gear case; and a wheel operatively connected to each of the terminal gearing differential wheels for propelling the toy car.

2. The tutorial toy car of claim 1, wherein at a bottom of the shell body, a battery box and a power switch are provided, and wherein multiple metal buttons are provided at a back of the shell body, the multiple metal buttons being connectable with the left motor, the right motor, the battery box, and the power switch.

3. The tutorial toy car of claim 1, further comprising a stationary hook on both sides of front of the shell body.

4. The tutorial toy car of claim 1, wherein at a top surface of shell body, multiple flat hexagonal convexities are provided.

5. The tutorial toy car of claim 1, wherein at the top surface of the shell body, also sets up multiple groove hexagonal convexities are provided with radial grooves and a central hole, the groove hexagonal convexities receive a hexagonal nail and a round pole is fixed under a center of the hexagonal nail and insertable into the hole of groove hexagonal convexities.

6. The tutorial toy car of claim 1, wherein at least the central differential wheel, bottom differential wheel, gearing differential wheel and terminal gearing differential wheel are all readily replaceable.

7. The tutorial toy car of claim 6, wherein a board is provided on a top of the shell body and wherein control circuits are operatively mounted on the board, the control circuits being readily accessible and visible.

8. The tutorial toy car of claim 7, further comprising a battery box and a power switch within the shell body and multiple metal buttons connected to the battery box and the power switch, the control circuits being readily connectable to the metal buttons by a connection exterior to the shell body to thereby control operation of the toy car.

* * * * *